United States Patent [19]

Simkins et al.

[11] 4,302,261

[45] Nov. 24, 1981

[54] REINFORCED TUBULAR ARTICLES

[75] Inventors: Roy Simkins, Castle Vale; James F. Yardley, near Burton-on-Trent, both of England

[73] Assignee: Dunlop Limited, London, England

[21] Appl. No.: 114,734

[22] Filed: Jan. 24, 1980

[30] Foreign Application Priority Data

Jul. 19, 1978 [GB] United Kingdom ..... 30421/78

[51] Int. Cl.[3] ..... B65H 81/00

[52] U.S. Cl. ..... 156/64; 156/143; 156/195; 156/350; 156/429

[58] Field of Search ..... 156/143, 195, 425, 428–432, 156/350, 64

[56] References Cited

U.S. PATENT DOCUMENTS

| | | | |
|---|---|---|---|
| 3,173,822 | 3/1965 | Rigaut | 156/429 |
| 3,300,812 | 1/1967 | Dasquetti | 156/195 |
| 3,533,883 | 10/1970 | Gartaganis | 156/195 X |

FOREIGN PATENT DOCUMENTS

| | | | |
|---|---|---|---|
| 2711236 | 11/1977 | Fed. Rep. of Germany | 156/143 |
| 865562 | 4/1961 | United Kingdom . | |
| 1347873 | 2/1974 | United Kingdom . | |
| 1424176 | 2/1976 | United Kingdom . | |

*Primary Examiner*—David A. Simmons

*Attorney, Agent, or Firm*—Stevens, Davis, Miller & Mosher

[57] ABSTRACT

The production of a reinforced tubular article employs a rotatable roller (1) and a fixed mandrel (3) which are spaced apart so as to define a nip (4) there-between. A strip (5) of reinforced polymeric material is fed through said nip and caused to wind helically around the mandrel (3) by the action of the rotatable roller (1), thereby forming a tubular article (7) the wall thickness of which is equal to size of the nip (4).

A carrier strip (11) of low friction material may be provided to assist movement of the reinforcing strip (5) over the mandrel (3). Said movement may be further assisted by arranging the rotatable roller in skewed relation relative to the fixed mandrel.

13 Claims, 12 Drawing Figures

REINFORCED TUBULAR ARTICLES

This invention relates to a method and apparatus for producing reinforced tubular articles such as hose.

According to one aspect of the present invention a method of producing a reinforced tubular article comprises helically winding a strip of reinforced polymeric material such that successive turns are in contact with one another, said strip being fed through the nip defined by a rotatable roller and a fixed mandrel and caused to wind around the fixed mandrel by the action of the rotatable roller, the width of the nip being equal to the desired wall thickness of the tubular article.

Preferably the strip of reinforcement material has an initial thickness greater than the width of the nip, and is compressed by said nip.

According to a further aspect of the present invention an apparatus for the production of a reinforced tubular article comprises means for feeding a strip of reinforced polymeric material helically through the nip between a rotatable roller and a fixed mandrel, the width of the nip being equal to the desired wall thickness of the tubular article.

The coefficient of friction between the surface of the mandrel and the surface of the reinforced tubular article should be less than 1, preferably less than 0.5, more preferably less than 0.25.

The polymeric material may comprise a thermoplastic rubber (e.g. an ABA styrene-butadiene block copolymer or a blend of a high ethylene content EPDM with polypropylene and/or polyethylene), a vulcanizable rubber (e.g. ethylene/propylene rubber, ethylene/propylene/diene rubber, nitrile rubber, polychloroprene rubber, polyisoprene rubber and SBR), a thermosetting plastics material (e.g. a peroxide cross-linkable ethylene/vinyl acetate copolymer) or a thermoplastic plastics material (e.g. polypropylene, polyethylene and polyvinyl chloride) or a blend of any of these and may contain bonding ingredients (e.g. aldehyde condensation resin forming ingredients such as resorcinol and hexamethylene tetramine).

The reinforcement may comprise a thermoplastic rubber (e.g. a blend of a high ethylene content EPDM with polypropylene and/or polyethylene), a vulcanizable rubber, a thermosetting plastics material (e.g. a glass reinforced polyester or epoxy resin), a thermoplastic plastics material (e.g. polypropylene, polyethylene, poly(vinyl chloride) polycarbonate or an aliphatic polyamide, such as nylon), fibrous material (e.g. carbon, glass, steel, carbon or polyester) or a blend of any of these. If fibrous material is used in the reinforcement it may be in a discontinuous fibre form orientated in the direction of the strip of polymeric material and may be pretreated e.g. treated unregenerated cellulosic fibres (available as Santoweb from Monsanto). Preferably the ratio of length:diameter of the fibrous material used is more than 5:1 and more preferably more than 10:1.

The reinforcement may be in a mono filament form, e.g. rod-like, or of multifilament form e.g. in a cabled, stranded or yarn construction.

The strip of reinforced polymeric material may be produced by extruding the polymeric material around the reinforcement by means of a cross-head die. The cross-section of the reinforced strip may for example be square, rectangular, or circular and that of the reinforcement may for example be square, rectangular or circular. Other cross-sectional shapes such as parallelogramatic section may be used, the facing surfaces of successive turns being of substantially complementary shape. Particularly where the strip is substantially rectangular in cross-section it may incorporate more than one reinforcement element. As the strip is helically wound around the mandrel, adjacent coils should adhere to each other by means of e.g. tack or melting or adhesive.

In the final reinforced tubular article preferably all components are bonded together and any vulcanizable or thermosettable compositions vulcanised or thermoset respectively. For example where the reinforced polymeric material includes a plastics composition and a vulcanizable rubber composition, said compositions may be fusion bonded together. The completed tubular article may be heated so as to vulcanize the rubber composition (e.g. in an autoclave, fluid bed, salt bath or microwave unit) at a temperature above that which will melt the plastics so as to effect a bond. Alternatively the rubber composition can be vulcanized at a temperature below that which will melt the plastics and then the temperature can be raised to melt the plastics and thus bond the composite.

Curing treatment of the tubular article, e.g. to vulcanize or thermoset any vulcanizable or thermosettable compositions, may take place as a separate process following formation of a length of the tubular article or may take place concurrently with said formation.

Preferably drive means is provided downstream to the mandrel to assist rotation of the newly formed tubular article and thereby also assist in ensuring that the article does not become twisted or distorted. The provision of said drive means is particularly useful where a continuously formed length of tubular article is subject to a curing treatment involving the application of heat concurrently with its formation because the heat applied during curing may soften the reinforced polymeric material and reduce the articles inherent resistance to twisting and distortion.

To ensure that the drive means rotates the newly formed article at an appropriate speed related to the speed at which the article is formed by rotation around the mandrel it is preferred that sensing means is provided to detect the torque or any change of torque in an uncured length of the tubular article resulting from a difference between the rotational speed at the mandrel and at the drive means. Optionally the sensing means may be incorporated in the drive means to sense the torque exerted thereby.

The diameter of the tubular article is determined primarily by the stationary mandrel but may be varied relative thereto by adjusting the speed of the incoming reinforced polymeric strip relative to that of the rotating roller. In addition the reinforcement in the strip should be sufficiently rigid at the process temperature so as to be able to be tensioned in order to control the hose diameter.

The longitudinal axis of the mandrel and roller, being also the rotational axis of the roller, may be parallel or at a small acute angle to each other.

The axes may be angled such that the nip between the roller and mandrel decreases along the length of the mandrel from the end at which the strip is applied. The angle selected will depend in part on the length of the mandrel, and difference between the initial thickness of the strip and width of the nip; typically the angle will lie in the range 0° to 2°.

The axes may be additionally or alternatively skewed relative to one another such that the axis of the roller lies substantially perpendicular to the strip material in the nip between the roller and mandrel. Typical skew angles envisaged lie in the range $\frac{1}{4}°$ to 10°, though other angles could be used.

The temperature of the mandrel and roller may be controlled as desired depending on the hose materials being used.

Means may be provided for reducing friction between the surface of the mandrel and the surface of the tubular article e.g. a solid means such as a carrier strip, a liquid means or a gaseous means. A carrier strip may be used, either continuous or not, and it may be removed from the reinforced tubular article at any stage or not at all. Suitable strip materials include polytetrafluoroethylene (Teflon), cellulose acetate, and polyethylene terephthalate (Melinex). Preferably the width of the carrier strip is about the same width as that of the strip of reinforced polymeric material.

If desired a further layer or layers can be applied to the reinforced tubular article e.g. by a conventional wrapping technique.

Several embodiments of the invention will now be described, by way of example only, with reference to the accompanying diagrammatic drawings in which.

Figure 1:
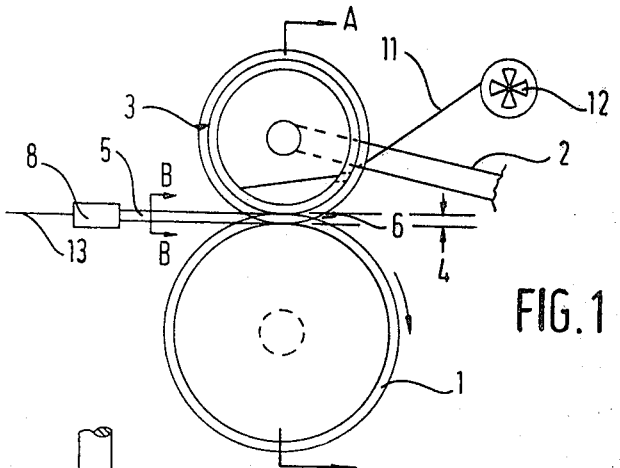
FIG. 1 is a side view of apparatus according to the present invention.
Figure 9:
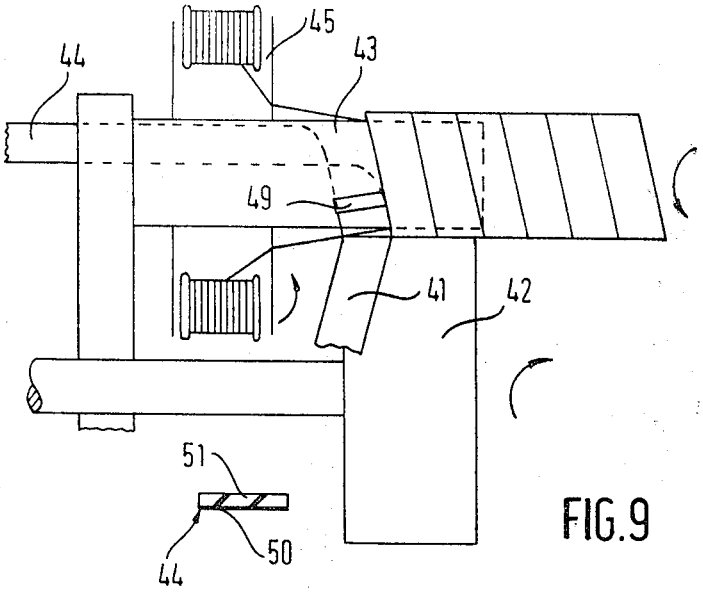
Figure 10:
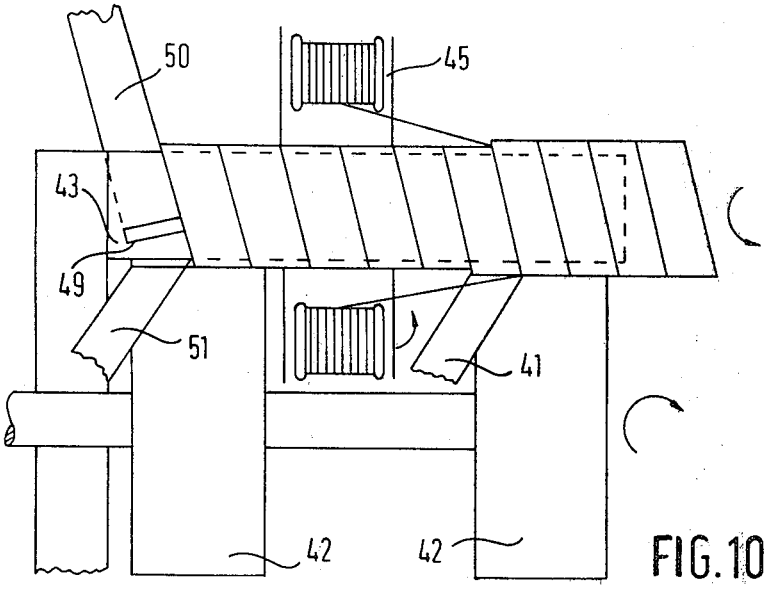
Figure 11:
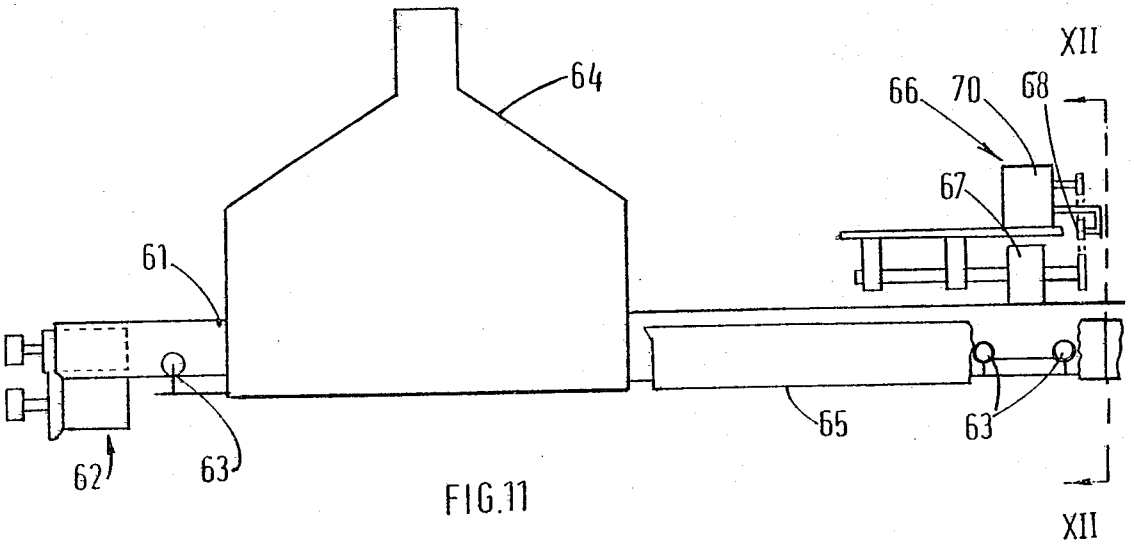
Figure 12:
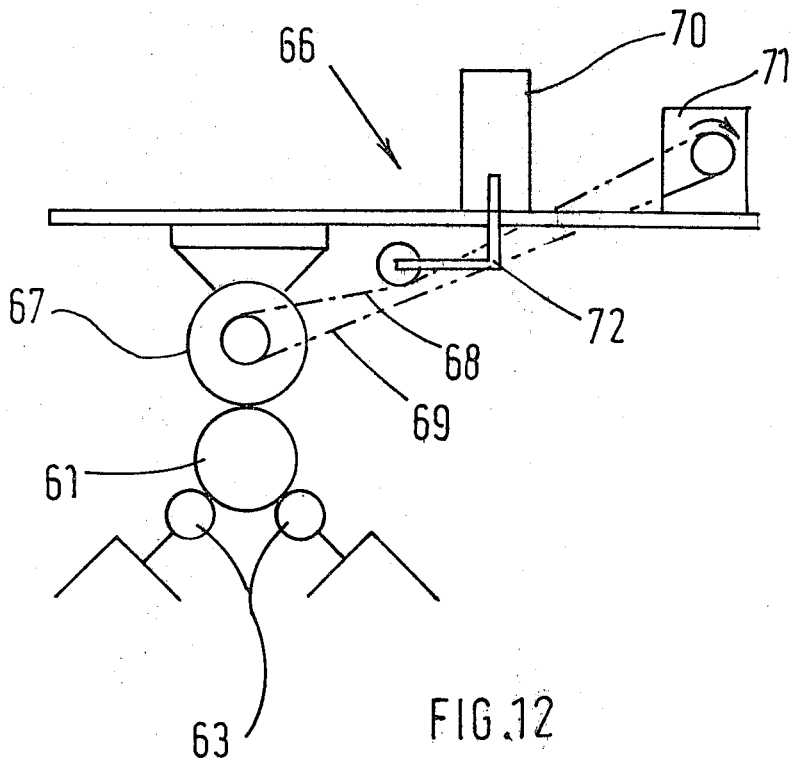

FIGS. 9 and 10 each show side views of further embodiments of the present invention;

FIG. 11 is a side view of a curing apparatus in combination with the apparatus of FIG. 1, and FIG. 12 is an end view in the direction 12—12 of FIG. 11.

A rotatable roller 1 (driven in the direction indicated by the arrow by means e.g. friction or gears not shown) and a fixed mandrel 3 supported by means of an arm 2, define therebetween a nip 4 which is selected to be equal in width to the desired wall thickness of the tubular article. Force is applied by means not shown to press the roller 1 against the mandrel 3 at position 6.

Figure 2:
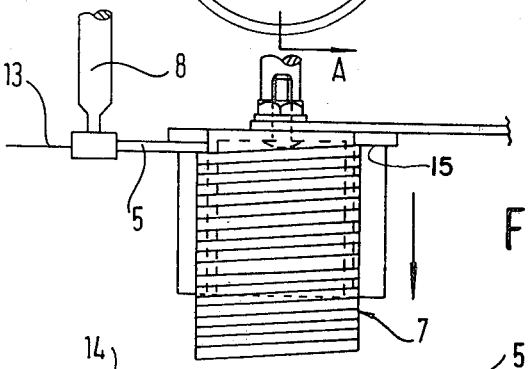
FIG. 2 is a plan view of the apparatus of FIG. 1.
Figure 3:
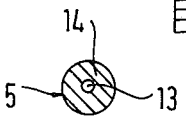
FIG. 3 is a cross-sectional view along line B—B of FIG. 1.
Figure 5:
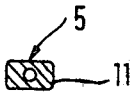
FIG. 5 is a cross-sectional view in detail of the strip of reinforced polymeric material as shown in FIG. 4.
Figure 6:
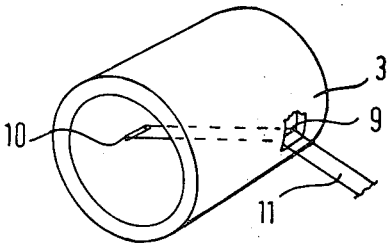
FIG. 6 is a perspective view of the mandrel of FIG. 1.

The reinforced tubular article 7 is made from a strip 5 of reinforced polymeric material initially having a circular cross-section as shown in FIG. 3, but which is squeezed to a rectangular cross-section (see FIG. 5) in the nip 4 as the tubular article 7 is formed. The initial diameter of said strip 5 is greater than the width of the nip 4. A cross-head die 8 (see FIG. 2) feeds the strip 5 into the nip 4. FIG. 6 shows the mandrel 3 which has holes 9 and 10 through which may be fed a carrier strip 11 from a spool 12 (see also FIG. 1).

In use of the apparatus a thermoplastic rod 13 of circular cross-section is passed through the cross-head die 8 where it receives an extruded covering 14 of a vulcanizable rubber composition, its cross-section being still circular. The thus formed strip 5 is then passed through the nip 4 onto the carrier strip 11, and is pushed around the outside of mandrel 3 by the action of the rotating roller 1. Flange 15 at one end of the rotating roller 1 prevents movement of the strip 5 away from the formed tubular article 7; the tubular article 7 moves in the opposite direction as shown by the arrow in FIG. 2. The rubber in the finished tubular article 7 can then be vulcanized and the carrier strip 11 can be removed or left in place as lining or additional reinforcement. FIG. 5 is a cross-sectional view of the strip 5 after passing through nip 4 and being combined with the carrier strip 11 which becomes at least temporarily adhered to the strip covering 14.

Figure 7:
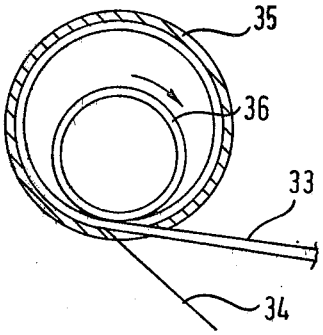
FIG. 7 is a cross-sectional view of another embodiment of the present invention.

In the embodiment shown in FIG. 7, a rotatable roller 36 (driven in the direction of the arrow by means e.g. friction or gears not shown) and a fixed mandrel 35 define therebetween a nip which is equal to the desired wall thickness of the tubular article and less than that of the strip 33 to be fed through it. A carrier strip 34 is fed to the inside of the mandrel 35 from a spool (not shown). In use of the apparatus the strip 33 is passed through the nip and around the inside of the mandrel 35 by the action of the rotating roller 36. The rotating roller 36 may either have a flange (as in FIGS. 4 to 6) to prevent the tubular article from moving in the wrong direction and to govern the width of the nip, or may be used in conjunction with the arrangement shown in FIG. 8.

Figure 4:
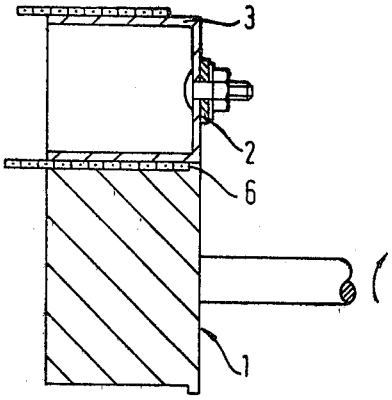
FIG. 4 is a cross-sectional view along line A—A of FIG. 1.
Figure 8:
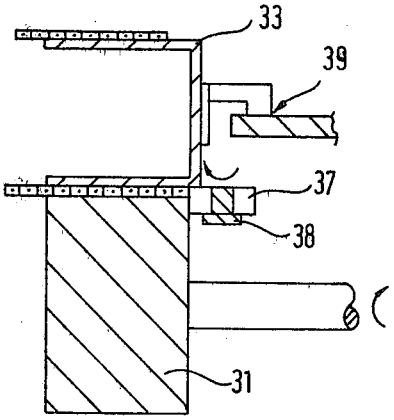
FIG. 8 is a cross-sectional view of a modified form of part of the apparatus of FIG. 4.

In FIG. 8 an alternative to the flange arrangement of FIG. 4 is shown. This comprises a rotating roller 37 mounted on an arm 38 and pressing against the rotating roller 31 to prevent the tubular article moving in the wrong direction. A stop 39 prevents the two rollers 31, 33 touching.

In a further embodiment illustrated in FIG. 9 a reinforced hose is constructed on apparatus comprising a non-rotatable hollow mandrel 43 and rotatable die roller 42 which are supported so as to define therebetween a nip equal in width to the required thickness of the resulting hose.

The mandrel 43 is substantially similar to that shown in FIG. 6 and is formed with a slot 49. A strip 44 of Melinex 50, optionally coated with rubber 51 (see inset on FIG. 9), may be fed from inside the mandrel and through said slot so as then to pass helically around the outer surface of the mandrel and act as support for other hose forming components.

Upstream of the slot the mandrel is surrounded by a rotatable creel 45 which carried a series of circumferentially spaced bobbins that provide axial hose reinforcement.

In use of the apparatus a strip of reinforcement material 41 of substantially ribbon-like form is applied to the mandrel substantially in line with the slot. The strip 41 is transported helically along the length of the mandrel and through the nip by means of a melinex strip the rubber coating 51 of which becomes bonded to the strip 41, during subsequent vulcanization thereof. Cords from the creel 45 are fed to between the melinex strip 44 and reinforcement strip 41; said creel is rotated at a speed which matches that of the reinforcement strip and thus the cords form an axially extending reinforcement in the finished hose.

In contrast to the earlier described embodiments of the invention, in accordance with this embodiment the reinforcement strip comprises a strip of rubber having a plurality of mutually parallel spaced apart reinforcement elements, e.g. cords, embedded therein. The reinforcement strips described in U.K. Pat. No. 1,356,791 have been found to be particularly suitable.

FIG. 10 shows a variation of the embodiment described with reference to FIG. 9. In this embodiment the creel is positioned downstream of the slot and forms an axially extending reinforcement between a first strip reinforcement layer and a second strip reinforcement layer which is formed by helical winding at a position downstream of the creel.

The afore-described methods may be performed continuously in combination with a curing unit and drive means which assists to ensure that the newly formed hose, or other tubular article, does not become twisted or distorted before being fully cured. One arrangement of a curing unit and drive means will now be described with reference to FIGS. 11 and 12.

Newly formed hose 61 issuing from a winding head 62 is supported for relatively free rotational movement by low friction ball units 63. The hose then passes through a curing chamber 64 which incorporates a fluidized bed that serves both to heat and cure the hose and also permit relatively free rotational movement thereof. The hose then enters a cooling unit 65 in which again it is supported by low friction ball units 63. Subsequently the hose passes under a torque sensitive drive mechanism 66 which will now be described in more detail.

The friction drive mechanism comprises in combination means for rotating the hose and means for sensing the torque being transmitted to the hose.

Means for rotating the hose comprises an electric motor 71 from which drive is transmitted to the hose via a flexible belt or chain 69 arranged to cause rotation of a friction drive roller 67 which engages the outer surface of the hose 61.

An idler roller 68 bears under its own weight against the drive length of the belt 69, and is rotatably supported at one end of an arm 72 the other end of which is pivotally mounted on an electronic monitor unit 70. The monitor unit is sensitive to movement of the arm caused by change in the tension of the drive length of belt 69, and is interconnected with the motor 71 to control the latter to maintain the drive tension substantially constant. In use of the aparatus the tension in the drive length of the belt is related to the rotational resistance of the length of hose passing through the curing chamber 64 and cooling unit 65, and thus the motor 71 can maintain the required torque in said length.

The torque required to rotate the hose will depend not only on the rotational resistance of the newly formed hose between the mandrel 62 and drive mechanism 66, but also that of the cured hose lying downstream of the mechanism 66 and of a continually increasing length. Accordingly the monitor unit 70 is provided with a signal from means (not shown) which records the length of hose produced, and the monitor is programmed to vary the required output of the motor 71 in response to that signal.

In an alternative construction of the drive mechanism the torque output of the motor may be determined by measuring the power consumption of the motor, the idler roller 68 and arm 72 then not being required.

The axis of the friction drive roller is mounted at a small angle relative to the axis of the hose equal to the pitch angle of the helix. Axial and rotational movement is thus transmitted to the hose.

It has been found that a particularly important feature of the present invention is the use of a driven roller to move the reinforcement strip around the mandrel. It has been found that this significantly assists movement of the strip mandrel around the mandrel.

Having now described our invention, what we claim is:

1. A method of producing a reinforced tubular article comprising helically winding a strip of reinforced polymeric material around a fixed mandrel such that successive turns are in contact with one another, by feeding said strip through the nip defined by a rotatable roller and said fixed mandrel to cause the strip to wind around the fixed mandrel by the action of the rotatable roller, the width of the nip being equal to the desired wall thickness of the tubular article; rotating the newly formed tubular article about the mandrel by drive means positioned downstream from the mandrel; maintaining the newly formed tubular article under a substantially uniform torque by sensing means connected to said drive means.

2. A method according to claim 1 wherein a carrier strip of low friction material is employed to assist movement of the strip of reinforced polymeric material over the mandrel.

3. A method according to claim 1 wherein the strip of reinforced polymeric material comprises a reinforcement core of plastics composition embedded in a vulcanizable rubber composition which can be vulcanized at a temperature below that which will melt the plastics.

4. A method according to claim 1 wherein the strip of reinforced polymeric material has an initial thickness greater than said width of the nip.

5. A method according to claim 1 in which the strip comprises curable polymeric material and in which the newly formed tubular article is subject to a curing treatment as it issues from the mandrel.

6. Apparatus for the production of a reinforced tubular article comprising a rotatable roller and a fixed mandrel spaced to define a nip therebetween; means for feeding a strip of reinforced polymeric material helically through said nip, the minimum width of the nip being equal to the desired wall thickness of the tubular article; drive means downstream of the mandrel to assist rotation of the newly formed tubular article; sensing means for control of the drive means to maintain a substantially uniform torque in the length of the tubular article between the mandrel and the drive means.

7. Apparatus according to claim 6 wherein a carrier strip of low friction material is provided to assist movement of a strip of reinforced polymeric material over the mandrel.

8. Apparatus according to claim 6 wherein the longitudinal axis of the mandrel is angled relative to the longitudinal axis of the roller.

9. Apparatus according to claim 8 wherein said axes are skewed relative to one another at an angle in the range $\frac{1}{4}°$ to 10°.

10. Apparatus according to claim 8 wherein said axes are angled such that the nip between the roller and mandrel decreases along the length of the mandrel from the end at which the strip is applied.

11. Apparatus according to claim 10 wherein said angle lies in the range 0° to 2°.

12. Apparatus according to claim 11 and incorporating a creel assembly rotatable substantially in unison with movement of the strip of reinforced polymeric material around the mandrel.

13. Apparatus according to claim 6 wherein curing means is provided between the mandrel and said drive means.

* * * * *